United States Patent [19]

Reiner

[11] Patent Number: 4,717,453

[45] Date of Patent: Jan. 5, 1988

[54] WEB FORMING DEVICE WITH RIGID CONCAVE/CONVEX PRESSURE PLATE

[75] Inventor: Per L. Reiner, Matfors, Sweden

[73] Assignee: Mölnlycke Aktiebolag, Gothenburg, Sweden

[21] Appl. No.: 824,007

[22] PCT Filed: Apr. 1, 1985

[86] PCT No.: PCT/SE85/00152

§ 371 Date: Dec. 9, 1985

§ 102(e) Date: Dec. 9, 1985

[87] PCT Pub. No.: WO85/04680

PCT Pub. Date: Oct. 24, 1985

[30] Foreign Application Priority Data

Apr. 10, 1984 [SE] Sweden ..... 8401995

[51] Int. Cl.[4] ..... D21F 1/02

[52] U.S. Cl. ..... 162/312; 162/315; 162/336; 162/317; 162/344

[58] Field of Search ..... 162/212, 312, 315, 336, 162/344, 347, 350, 317

[56] References Cited

U.S. PATENT DOCUMENTS

| | | | |
|---|---|---|---|
| 4,416,730 | 11/1983 | Schiel | 162/300 |
| 4,427,491 | 1/1984 | Radvan et al. | 162/344 |
| 4,565,603 | 1/1986 | Reiner et al. | 162/336 |

FOREIGN PATENT DOCUMENTS

| | | | |
|---|---|---|---|
| 79316 | 5/1983 | European Pat. Off. | 162/344 |
| WO80/02575 | 11/1980 | PCT Int'l Appl. . | |

*Primary Examiner*—S. Leon Bashore
*Assistant Examiner*—K. M. Hastings
*Attorney, Agent, or Firm*—Burns, Doane, Swecker & Mathis

[57] ABSTRACT

The device comprises a head box with a nozzle for applying a pulp suspension on a wire located below the nozzle. A pressure plate is located after the nozzle over the pulp suspension. The pressure plate comprises a concave formed portion, against which the pulp suspension is sprayed, and a subsequent convex formed portion. The fiber web is formed in a forming zone where dewatering is effected in that the convex portion of the pressure plate and an unsupported portion of the wire are pressed against each other.

16 Claims, 6 Drawing Figures

WEB FORMING DEVICE WITH RIGID CONCAVE/CONVEX PRESSURE PLATE

BACKGROUND AND SUMMARY OF THE INVENTION

This invention relates to a dewatering arrangement at the forming of a web from fibrous particles suspended in water. The invention particularly refers to a device applicable to the wet end of a papermaking machine.

In SE-PS No. 7904555-5 a method of forming paper is described where the forming process proper takes place between a flexible upper lip and an unsupported portion of the wire over an open suction box. The flexible upper lip is an extension of the stationary upper lip on a head box. This implies that the stock jet from the head box is directed downward to the sheet forming zone by the flexible lip, and that during the entire sheet forming process the stock layer is clearly defined as to its form. The absence of disturbances in the surface layer of the stock jet is a prerequisite for the grammage variations in the paper made to be maintained on a lower level. An additional improvement of the uniformity of the paper is obtained when the forming takes place with the influence of viscous shearing forces between the stationary upper lip and the movable wire. Due to the effect of the pressure difference between the atmospheric pressure and the low pressure in the suction box, the wire moves in a curved path. The flexible upper lip adapts itself to the form of the wire and thereby also assumes curved form. For producing the vacuum in the suction box, the box must be sealed on the sides. This sealing is made by means of adjustable sealing strips. This implies that, irrespective of the configuration of these strips, the wire will be curved three dimensionally along the sides over the suction box. The flexible upper lip, which should have a certain bending resistance, cannot fully adapt itself to the three dimensional form of the wire. Hereby certain edge disturbances can arise in the paper sheet formed, which may cause problems for the operativeness of the papermaking machine. These problems can be neglected for low paper grammages and for stocks easy to dewater, because only small pressure differences over the wire are required, resulting in a small downward deflection of the wire. For higher grammages, however, and for stocks more difficult to dewater higher pressure differences and also longer dewatering distances are required, which together result in a substantial downward deflection of the wire and consequently also in increased edge disturbances in the sheet formed.

A further disadvantage of the method is that great amounts of energy are required for generating the vacuum in the suction box.

One way of avoiding the aforesaid disadvantages, but still utilizing the advantages, is to generate the necessary dewatering pressure by means of an overpressure above the flexible lip over an unsupported portion of the wire. In this case the upper lip and wire are loaded in their entire extension across the papermaking machine, whereby only a two dimensional deflection is caused. The overpressure can be produced by means of an air cushion or a rigid pressure plate, which is designed so as to face the stock with a convex surface. In the case of a convex pressure plate, the plate can be utilized together with a flexible upper lip or it can entirely replace the same. Such an arrangement is proposed in U.S. Pat. No. 4,416,730.

In the U.S. patent the pressure plate (in said U.S. Pat. No. 4,416,730 called slide shoe) is described generally to have a surface curved convex toward the stock. The pressure plate further is rigidly connected to the head box and can be regarded as an extension of the upper (or lower lip) of the head box. In embodiments of the patent, the stock jet is transported after the outlet opening along a convex surface where the opposed surface, at least for a certain distance, is a free liquid surface. The disadvantage of this method will be described in greater detail below where also the invention, on which this application is based, will be described.

DETAILED DESCRIPTION OF THE PREFERRED EMBODIMENT

Figure 1:
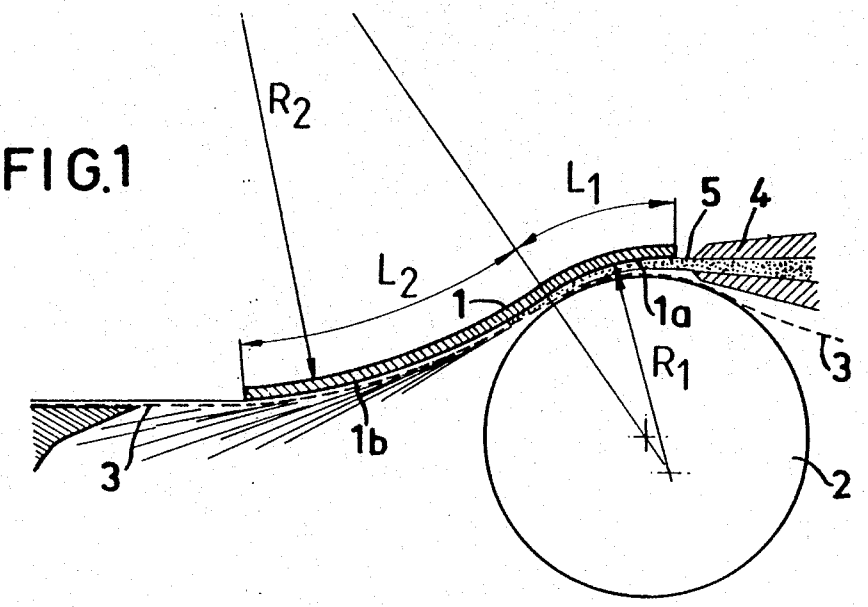
FIG. 1 is a side view of the rigid pressure plate showing the concave and convex sections, the head box, the stock jet and wire supporting roll.

In FIG. 1 a pressure plate 1 is shown, which substantially consists of two sections, a first one 1*a*, which towards the stock has a concave surface with a radius of curvature $R_1$ and extension $L_1$, and a second section 1*b*, which faces the stock with a convex surface with a radius of curvature $R_2$ and extension $L_2$. The rigid pressure plate 1 joins a roll 2, in such a manner, that the shortest distance between the pressure plate and roll is located at the inflection point of the pressure plate, i.e. where the curvature of the pressure plate transforms from concave to convex. The roll 2 supports a wire 3. From the outlet opening 4 on a head box a stock jet 5 is sprayed substantially tangentially inward to the concave surface 1*a* of the pressure plate. The stock jet follows the concave surface on the pressure plate downward to the inflection point where it is enclosed between the pressure plate and wire. Along the convex surface of the pressure plate the sheet forming zone proper is located, where the dewatering takes place.

Figure 2:
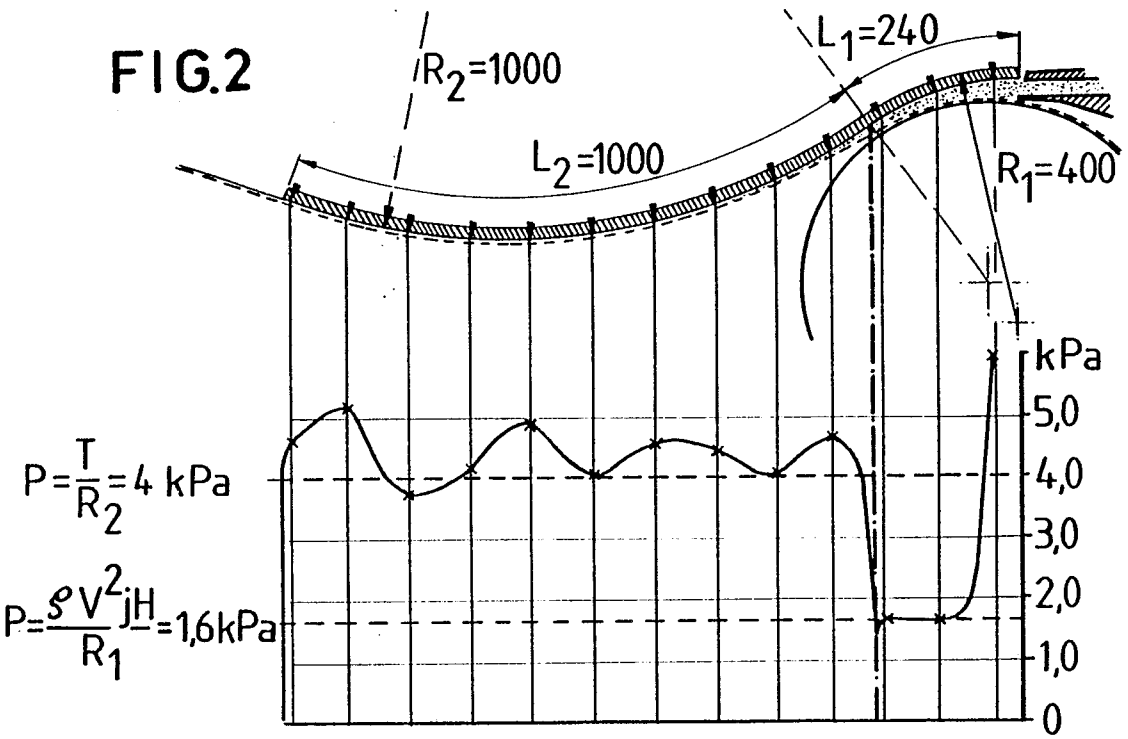
FIG. 2 shows the concave and convex sections with respect to the hydrostatic pressure developed under various points of the plate.

In order to additionally illustrate the sheet forming conditions, in FIG. 2 the hydrostatic pressure is shown which was measured beneath the pressure plate on an experimental papermaking machine during a test run. The essential measures of the pressure plate are indicated in mm in the Figure. For the test, the papermaking machine was run at a speed of 400 m/min. The jet speed V out of the head box was 480 m/min, and the outlet opening on the head box was 10 mm, the thickness H of the jet was consequently also 10 mm. At its transport along the concave surface on the pressure plate, the jet is influenced by the centrifugal force. The static pressure produced by this force on the surface of the pressure plate can be calculated according to the equation as follows:

$$P = \frac{\rho \cdot V_J^2 \cdot H}{R_1} \quad (1)$$

where

P=static pressure (Pa)

$\rho$=water density (kg/m$^3$)

$V_J$=jet speed (m/s)

H=jet thickness (m)

$R_1$=curvature radius of concave surface (m)

The advantage of causing the jet from the head box to be transported along a concave surface down to the sheet forming zone is apparent. Due to the pressure build-up along the pressure plate, air is prevented from being sucked in between the plate and jet. It is hereby possible to separate the pressure plate from the head box, which can be advantageous from a design point of view.

Furthermore, as the static pressure increases inward to the pressure plate, air possibly included in the stock is transported outward to the free surface of the jet. A third advantage is that the centrifugal force has a damping effect on disturbances at the free surface of the jet, so that a jet of uniform thickness is delivered down to the sheet forming zone.

When the transport of a stock jet along a curved concave surface, as described above, is considered, correspondingly to take place along a convex surface, it is readily understood that the clear advantages turn into obvious disadvantages.

At the transport of a stock jet along a convex surface, analogous to the aforesaid, a pressure arises along the surface of the pressure plate, but the pressure has a reversed sign, i.e. it is a vacuum instead of an overpressure. When there is a vacuum along the surface of the pressure plate, there is risk of air being sucked in between plate and jet. One prerequisite of preventing this to take place is, that the pressure plate is connected air-tight to the head box.

Under conditions prevailing in practice it is next to impossible to avoid air admixture to the stock. At a convex surface, i.e. where the pressure in the stock layer decreases inward to the pressure plate, the air migrates to the pressure plate where an air layer rapidly is built up, due to which the jet is separated from the pressure plate.

Contrary to the aforesaid applying to the concave surface, the centrifugal force influences a stock jet moving along a convex surface in such a manner, that disturbances which are present at the free liquid surface are increased.

Conclusively, a configuration of the pressure plate according to the patent cited above implies, that the stock jet at its arrival at the sheet forming zone very probably has been broken up. This will result in a paper reflecting the quality of the stock jet.

In close connection to the inflection point, according to FIG. 2, the stock jet is enclosed between the pressure plate and wire. Along the convex surface of the pressure plate the wire will press against the pressure plate and the stock jet lying therebetween. The size of this pressure depends on the tensile stress T in the wire and the curvature radius of the wire, which radius substantially corresponds to the curvature radius $R_2$ of the pressure plate. This relation is described by the equation as follows:

$$P = T/R_2 \quad (2)$$

where

P=static pressure (Pa)

T=wire tension (N/m)

$R_2$=curvature radius of convex surface (m)

As appears from FIG. 2, the pressure measured along the entire length of the pressure plate agrees pretty well with the theoretical ones.

The pressure measured beneath the convex portion of the pressure plate corresponds substantially to the dewatering pressure. The dewatering capacity of a pressure plate in a first approximation can be set proportionally to the dewatering impulse I according to:

$$I = \int_0^{\tau} P_t \cdot dt \quad (3)$$

where

I=dewatering impulse (Pa.s)

$P_t$=size of the pressure pulse at time t (Pa)

$\tau$=duration of pressure pulse (s)

The equation (3) can be developed according to $$I = \frac{1}{u_w} \int_0^{L_2} \cdot P \cdot dl \quad (4)$$

where $u_w$=wire speed (m/s)

The dewatering capacity, thus, is proportional to the surface below the pressure curve according to FIG. 2.

Experiences a.o. from papermaking with twin wire machines have shown, that the uniformity of the paper depends on the appearance of the pressure pulse. This pulse, as has become apparent from the aforesaid, can be affected by means of the radius of curvature of the convex portion of the pressure plate. In the above examples the convex portion of the pressure plate has had a uniform curvature radius. Within the scope of the present invention nothing objects to the curvature radius varying along the dewatering distance. Two embodiments thereof are shown in the following.

Figure 3:
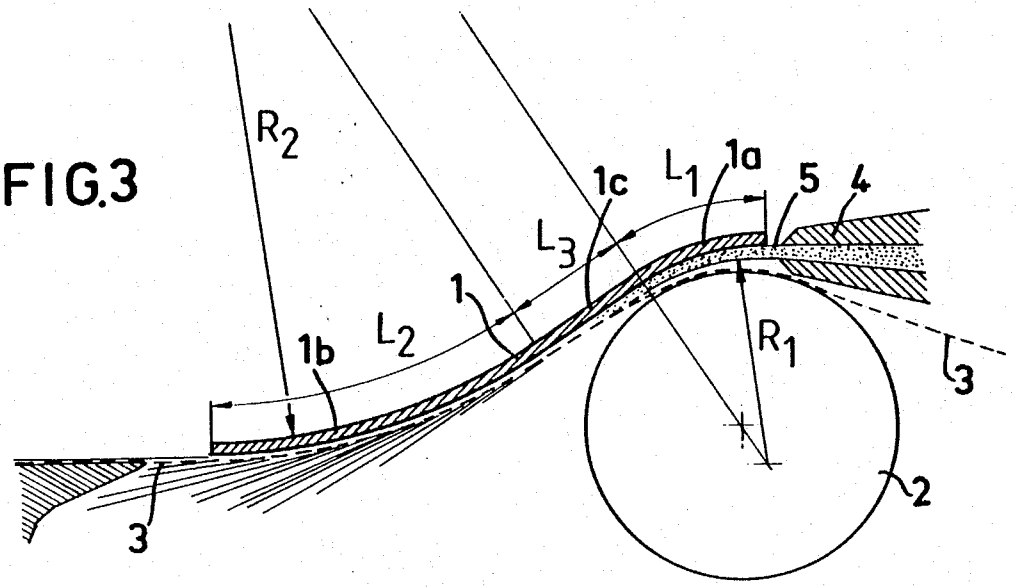
FIG. 3 is an additional embodiment of the pressure plate including a straight section between the concave and convex sections.

FIG. 3 shows a pressure plate according to FIG. 1, but where between the concave and convex sections a straight section 1*c* with an extension $L_3$ is provided. This pressure plate yields a pressure pulse where the pressure slowly increases up to the level corresponded by $P=T/R_2$.

Figure 4:
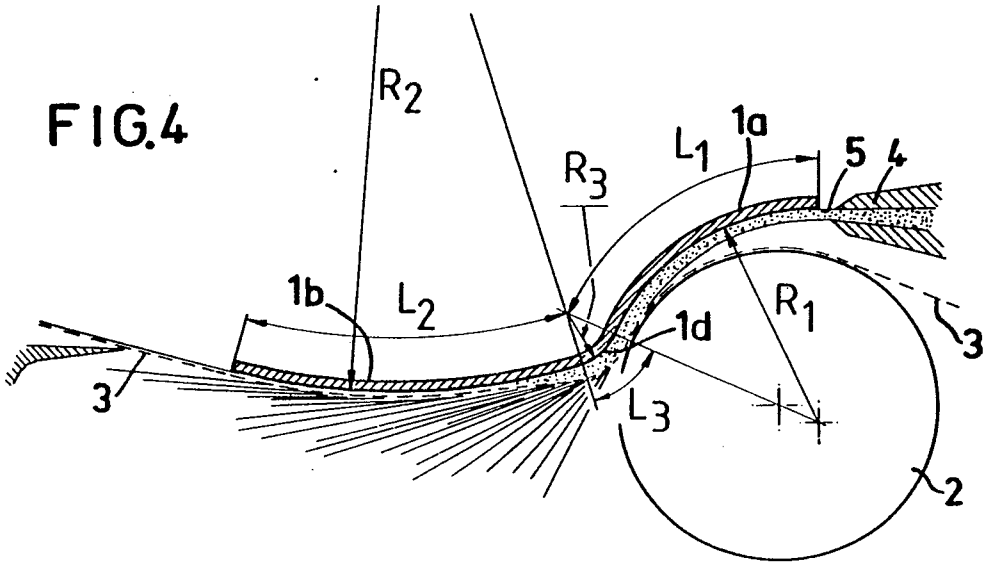
FIG. 4 is another embodiment of the pressure plate with an additional convex section.

FIG. 4 again shows a pressure plate according to FIG. 1, but where between the aforesaid first and second section a third convex section 1*d* is provided. The curvature radius $R_3$ of this section is smaller than the curvature radius $R_2$ in the subsequent section. By this design a pressure pulse is yielded which rapidly rises to a level corresponding to $P=T/R_3$ whereafter the pressure drops to a level corresponding to $P=T/R_2$.

Figure 5:
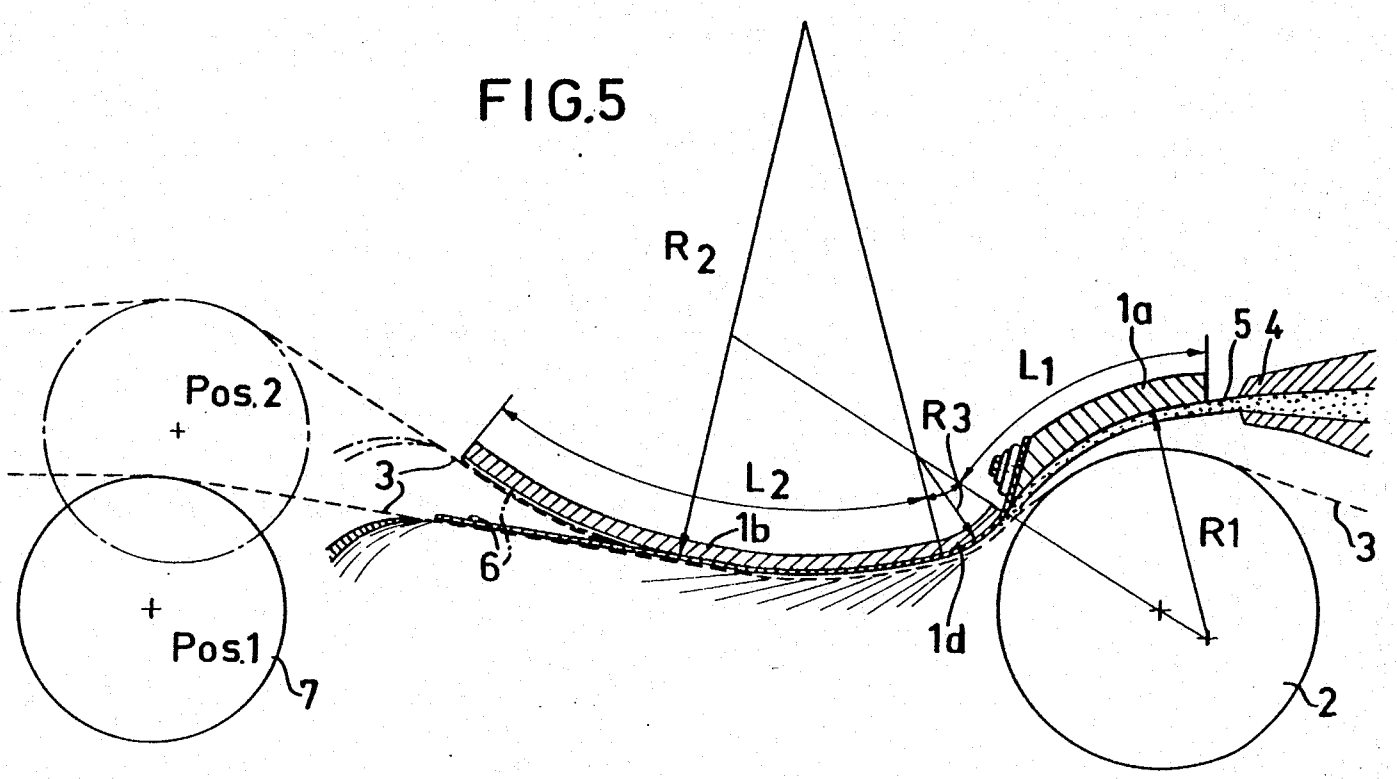
FIG. 5 is a further embodiment of the pressure plate with the concave and convex sections physically separated.

FIG. 5 shows an embodiment, which also is comprised within the scope of the present invention. The configuration seen here is similar to that in FIG. 4, but the first concave section 1*a* of the pressure plate is physically separated from the convex sections of the pressure plate. There is no significant difference in respect of the effect on the stock jet, because a flexible plate 6 is rigidly connected to the first concave section and extends along the concave surfaces so as to connect the flow of the concave section with that of the convex sections. The flexible plate has a total length corresponding to the length of the convex sections and is attached so on the concave section, and the convex sections geometrically are so arranged that there is a soft transition for the stock jet between the concave section and the flexible plate, which assumes the convex shape of the subsequent convex sections. The arrangement according to this Figure has the advantage, that the length of the dewatering zone can be varied, for example, by the position of a guide roll 7, which affects the direction of the wire after the pressure plate. By changing the direction of the wire, the enclosing by the wire of the convex surface of the pressure plate, and thereby the dewatering capacity, can be varied. The combination of the flexible plate and the convex portion of the pressure plate renders it possible to utilize a limited portion of the convex surface of the pressure plate without the risk of destroying the sheet formed in a diverging gap between plate and wire.

The aforedescribed devices according to the invention, preferably together with separate head boxes, can be attached in series in a wire course for forming multiply paper.

Figure 6:
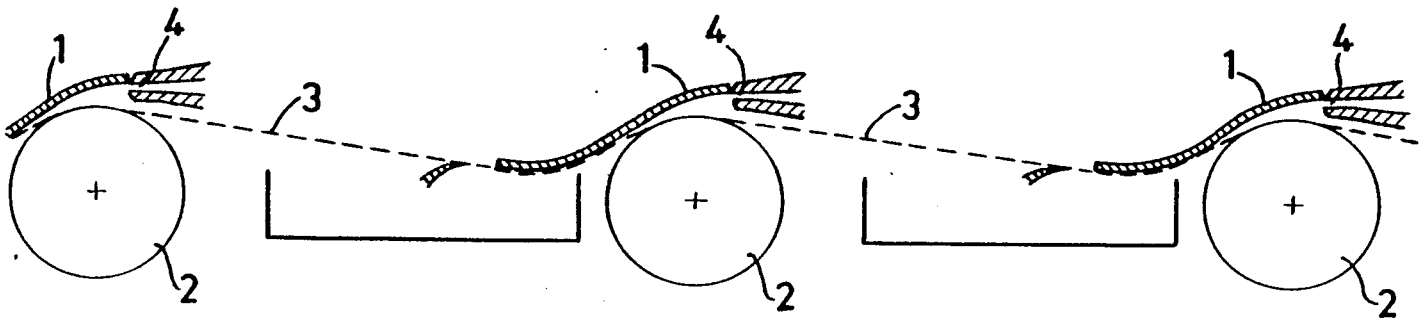
FIG. 6 is a side view of a series arrangement of a plurality of the web forming devices of FIG. 1.

FIG. 6 shows an example of such an arrangement.

Instead of forming an additional fibre layer in a second step, the arrangement can be used for applying on a previously formed layer, for example, filler, e.g. clay, or a second step can imply that a chemical solution is applied and dewatered, for example washing liquor in a wire washer room.

What is claimed is:

1. A device for forming a fiber web from a fiber pulp suspension, including a head box with a nozzle for applying the pulp suspension on a wire movable past the nozzle, comprising:

a pressure plate located after the nozzle and over the pulp suspension, the pressure plate having a rigid concave formed portion adjacent the nozzle and facing the pulp suspension and a rigid convex formed portion facing the pulp suspension, the wire having an unsupported portion, said pressure plate being arranged so that the pulp suspension follows the rigid concave formed portion under influence of centrifugal force in the absence of contact with the wire whereby substantially no dewatering of the suspension occurs along said rigid concave formed portion;

the rigid convex formed portion and the unsupported portion of the wire defining a forming zone where the pressure plate and the wire are pressed against each other so as to effect dewatering of the pulp suspension.

2. A device as defined in claim 1, wherein the nozzle is directed so that the pulp suspension is sprayed tangentially against the concave portion of the pressure plate.

3. A device as defined in claim 1, wherein the convex portion of the pressure plate has a varying radius of curvature along the forming zone.

4. A device as defined in claim 1, wherein the pressure plate further includes an additional portion between the concave and the convex portion, said additional portion being plane and located above the unsupported portion of the wire so as to define a section of the forming zone.

5. A device as defined in claim 1, wherein a flexible plate is located on the pressure plate between the pressure plate and the pulp suspension, the flexible plate extending along the pressure plate at least along the forming zone to an end of the pressure plate remote from the nozzle, said flexible plate unattached to said pressure plate along the forming zone.

6. A device for forming a fiber web from a fiber pulp suspension, including a head box with nozzle for applying the pulp suspension on a wire movable past the nozzle, comprising:

a pressure plate located after the nozzle and over the pulp suspension, the pressure plate having a rigid concave formed portion that is rigid under operating conditions adjacent the nozzle and facing the pulp suspension and a rigid convex formed portion that is rigid under operating conditions facing the pulp suspension, the wire having an unsupported portion, said pressure plate being arranged so that the pulp suspension follows the rigid concave formed portion under influence of centrifugal force in the absence of contact with the wire whereby substantially no dewatering of the suspension occurs along said rigid concave formed portion;

the rigid convex formed portion and the unsupported portion of the wire defining a forming zone where the pressure plate and the wire are pressed against each other so as to effect dewatering of the pulp suspension;

wherein the forming zone is of variable length, and a flexible plate is attached to the pressure plate between the rigid concave portion and the rigid convex portion, and extends along the fiber web formed in the forming zone.

7. A device as defined in claim 1, wherein the pressure plate is unattached to and spaced from the nozzle, and the pressure plate and the nozzle are adjustable independently of each other.

8. A device as defined in claim 1, wherein the concave portion has a radius of curvature between 150 and 600 mm and a length between 100 and 500 mm.

9. A device as defined in claim 2, wherein the convex portion of the pressure plate has a varying radius of curvature along the forming zone.

10. A device as defined in claim 3, wherein the pressure plate further includes an additional portion between the concave and the convex portion, said additional portion being plane and located above the unsupported portion of the wire so as to define a section of the forming zone.

11. A device as defined in claim 2, wherein a flexible plate is located on the pressure plate between the pressure plate and the pulp suspension, the flexible plate extending along the pressure plate at least along the forming zone to an end of the pressure plate remote from the nozzle, said flexible plate unattached to said pressure plate along the forming zone.

12. A device as defined in claim 3, wherein a flexible plate is located on the pressure plate between the pressure plate and the pulp suspension, the flexible plate extending along the pressure plate at least along the forming zone to an end of the pressure plate remote from the nozzle, said flexible plate unattached to said pressure plate along the forming zone.

13. A device as defined in claim 4, wherein a flexible plate is located on the pressure plate between the pressure plate and the pulp suspension, the flexible plate extending along the pressure plate at least along the forming zone at an end of the pressure plate remote from the nozzle, said flexible plate unattached to said pressure plate along the forming zone.

14. A device as defined in claim 2, wherein the pressure plate is unattached to and spaced from the nozzle, and the pressure plate and the nozzle are adjustable independently of each other.

15. A device as defined in claim 3, wherein the pressure plate is unattached to and spaced from the nozzle, and the pressure plate and the nozzle are adjustable independently of each other.

16. A device as defined in claim 4, wherein the pressure plate is unattached to and spaced from the nozzle, and the pressure plate and the nozzle are adjustable independently of each other.

* * * * *